US009644627B2

(12) United States Patent
Ito et al.

(10) Patent No.: US 9,644,627 B2
(45) Date of Patent: May 9, 2017

(54) GEAR PUMP

(75) Inventors: Takahiro Ito, Tokyo (JP); Isao Hayase, Tokyo (JP); Tadashi Osaka, Tokyo (JP); Azusa Amino, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 53 days.

(21) Appl. No.: 14/410,357

(22) PCT Filed: Jun. 28, 2012

(86) PCT No.: PCT/JP2012/066515

§ 371 (c)(1),
(2), (4) Date: Dec. 22, 2014

(87) PCT Pub. No.: WO2014/002225

PCT Pub. Date: Jan. 3, 2014

(65) Prior Publication Data

US 2015/0337836 A1 Nov. 26, 2015

(51) Int. Cl.
*F01C 19/02* (2006.01)
*F01C 19/10* (2006.01)
(Continued)

(52) U.S. Cl.
CPC ..... *F04C 15/0019* (2013.01); *F04C 2/14* (2013.01); *F04C 2/18* (2013.01); *F04C 15/0026* (2013.01);
(Continued)

(58) Field of Classification Search
CPC ..... F04C 15/0019; F04C 15/0026; F04C 15/0061; F04C 18/14; F04C 2/14; F04C 2/18; F04C 27/004; F04C 27/006
(Continued)

(56) References Cited

U.S. PATENT DOCUMENTS 2,993,450 A * 7/1961 Weigert ..... F04C 2/086 418/102
3,041,974 A * 7/1962 Judkins ..... F04C 11/001 418/132
(Continued)

FOREIGN PATENT DOCUMENTS

DE EP000427973 A1 * 5/1991 ..... F04C 15/00
JP 11-93792 A 4/1999
(Continued)

OTHER PUBLICATIONS

International Search Report (PCT/ISA/210) dated Sep. 4, 2012 with English translation (three pages).

*Primary Examiner* — Deming Wan
(74) *Attorney, Agent, or Firm* — Crowell & Moring LLP

(57) ABSTRACT

A gear pump includes a pair of gears that meshes with each other, two rotational shafts inserted into the respective gears that rotate together with gears, a pair of side plates arranged adjacent to both side surfaces of the gears, each having two through-holes forming bearings of the two shafts, a seal block that abuts against the pair of side plates and covers a part of the pair of gears, a pump assembly having the gears, the two shafts, the pair of side plates, and the seal block, and a case having a recess to accommodate the pump assembly. A line passing through an arc center of a cylindrical surface inscribed in the facing surface of the case, and parallel to the two shafts, forms a rotating axis. When the pump assembly rotates about the rotating axis, one of the of side plates contacts the inner wall of the case.

10 Claims, 6 Drawing Sheets

(51) Int. Cl.

| | |
|---|---|
| ***F03C 2/08*** | (2006.01) |
| ***F04C 27/00*** | (2006.01) |
| ***F01C 1/18*** | (2006.01) |
| ***F04C 18/18*** | (2006.01) |
| ***F04C 15/00*** | (2006.01) |
| ***F04C 2/14*** | (2006.01) |
| ***F04C 18/14*** | (2006.01) |
| ***F04C 29/00*** | (2006.01) |
| ***F04C 2/18*** | (2006.01) |

(52) U.S. Cl.
CPC ..... *F04C 15/0061* (2013.01); *F04C 18/14* (2013.01); *F04C 27/004* (2013.01); *F04C 27/006* (2013.01); *F04C 29/005* (2013.01)

(58) Field of Classification Search
USPC ..... 418/206.1, 131–135, 206.6
See application file for complete search history.

(56) References Cited

U.S. PATENT DOCUMENTS 3,472,170 A * 10/1969 Eckerle ..... F04C 2/18
418/126
6,047,684 A * 4/2000 Hiraku ..... F02M 37/041
123/497

FOREIGN PATENT DOCUMENTS

| | | | |
|---|---|---|---|
| JP | 2000-9054 | A | 1/2000 |
| JP | 2002-202070 | A | 7/2002 |
| JP | 2005-188372 | A | 7/2005 |

* cited by examiner

GEAR PUMP

TECHNICAL FIELD

The present invention relates to a gear pump.

BACKGROUND ART

The gear pump has been known as a pump installed in a vehicle, a construction machinery, or a machinery or device such as a robot as a hydraulic pressure source of an actuator. The gear pump has such a feature that pressure pulsations caused by pump operation are suppressed, and operation sound becomes smaller because the discharge amount of the pump per revolution of a drive shaft can be reduced as compared with a piston pump having the same size.

An example of a conventional gear pump is disclosed in Patent Literatures 1 and 2.

A gear pump disclosed in Patent Literature 1 includes a pump assembly having two gears, two side plates that come in narrow contact with the two gears, and a seal block that seals addendums of the gears, and a case that houses the pump assembly. The pump assembly rotates due to a reaction moment caused when a drive shaft rotationally drives gears, but a leading end of the seal block comes in contact with an inner wall of the case to stop the rotation of the pump assembly. The pump assembly is positionally fixed in this way, and positioned.

A gear pump disclosed in Patent Literature 2 includes a pump assembly having two gears and a seal block, and a case that houses the pump assembly, and the rotation of the pump assembly about a drive shaft stops due to a rotation stopper also serving as a suction port. The pump assembly is positionally fixed in this way, and positioned.

CITATION LIST

Patent Literature

Patent Literature 1: Japanese Unexamined Patent Application Publication No. Hei11 (1999)-93792

Japanese Unexamined Patent Application Publication No. 2002-202070

SUMMARY OF INVENTION

Technical Problem

In a conventional gear pump, the pump assembly rotationally stops so as to be positionally fixed, and is positioned within the case by bringing a leading end of the seal block into contact with an inner wall of the case, or by provision of a rotation stop member.

In a configuration of the conventional gear pump, one shaft is equipped with four bearings in total including two bearings (case bearings), and two bearings (side plate bearings) disposed on the side plates. In this case, the shaft is overstrained, and galling occurs in the side plate bearings, resulting in a possibility that a leakage increases from an abutment surface between the seal block and the side plates, and a torque increases during driving.

In order to avoid this drawback, in a technique disclosed in Patent Literature 1, a gap between the side plate bearings and the drive shaft is set to be larger than a gap between the case bearings and the drive shaft, to thereby prevent galling of the side plate bearings. In this configuration, because the drive shaft is pivotally supported by the case bearings, and the side plates are interposed between the case bearings and the gears, a distance between the gears and the bearings increases. Therefore, when a large load is applied to the gears as in a high pressure discharge operation, the deflection of the drive shaft at a gear position becomes larger. For that reason, a change in a seal state of the addendums between a low pressure state and a high pressure state becomes large, and particularly the efficiency has the potential to be lowered in the low pressure operation.

Also, in the techniques disclosed in Patent Literatures 1 and 2, because the bearings are required for the case, a size of the gear pump in the axial direction becomes larger, thereby making it difficult to reduce the size of the gear pump.

Also, in the techniques disclosed in Patent Literatures 1 and 2, a coaxial precision of the respective bearings arranged in two places of the case, and a positional precision between the case bearings and the rotation stop member are important to realize the gear pump with high efficiency. For that reason, in manufacturing the gear pump, not only to enhance a machining precision of the respective parts, but also to enhance an assembling precision is required. This makes it difficult to assemble the gear pump, resulting in the potential to lower the yield and increase the cost.

The present invention has been made in view of the above problems, and an object of the present invention is to provide a small gear pump that can reduce the deflection of the shaft, and can easily perform assembling without requiring high assembling precision.

Solution to Problem

The gear pump according to the present invention has the following features.

A gear pump including: a pair of gears that meshes with each other; two shafts that are rotationally supported, inserted into the pair of respective gears, and rotate together with the pair of gears; a pair of side plates that is arranged adjacent to both side surfaces of the pair of gears, and each have two through-holes forming bearings of the two shafts; a seal block that abuts against the pair of side plates, and covers a part of the pair of gears in a circumferential direction; a pump assembly having the pair of gears, the two shafts, the pair of side plates, and the seal block; and a case having a recess in which the pump assembly is accommodated, and having a facing surface that faces the seal block on an inner wall forming the recess, in which the pump assembly has a line passing through an arc center of a cylindrical surface which is inscribed in the facing surface of the case, and is parallel to two shafts as a rotating axis, and is hold to be rotatable about the rotating axis, and when the pump assembly rotates about the rotating axis, one of the pair of side plates comes in contact with the inner wall of the case.

Advantageous Effects of Invention

According to the present invention, there can be provided a small gear pump that can reduce the deflection of the shafts, and can easily perform assembling without requiring high assembling precision.

DESCRIPTION OF EMBODIMENTS

In a gear pump according to the present invention, a pump assembly is positionally fixed to a case which is a fixed part by a seal block and side plates which are not affected by a drive shaft. For that reason, an influence of swing of the drive shaft can be reduced without making a gap between the gearings (side plate bearings) disposed on the side plates and the drive shaft larger than a gap between a gap between bearings (case bearings) disposed on the case and the drive shaft, or without enhancing an assembling precision of the pump assembly and the case. In the gear pump according to the present invention, because the drive shaft and a driven shaft are supported by the bearings disposed on the side plates adjacent to the gears, there is a small difference in deflection of the shafts between a lower pressure operation and a high pressure operation, and a reduction in the efficiency is small even during operation at the wide pressure. Also, there is no need to enhance the assembling precision of the pump assembly and the case, only machining precision of the respective individual parts is enhanced whereby the efficiency of the gear pump can be enhanced. For that reason, the gear pump According to the present invention is easy in assembling, and can improve the yield and reduce the costs.

Problems, configurations, and advantages of the present invention, other than those described above will become apparent from a description of the following embodiments. Hereinafter, a gear pump according to embodiments of the present invention will be described with reference to the drawings.

First Embodiment

Figure 1:
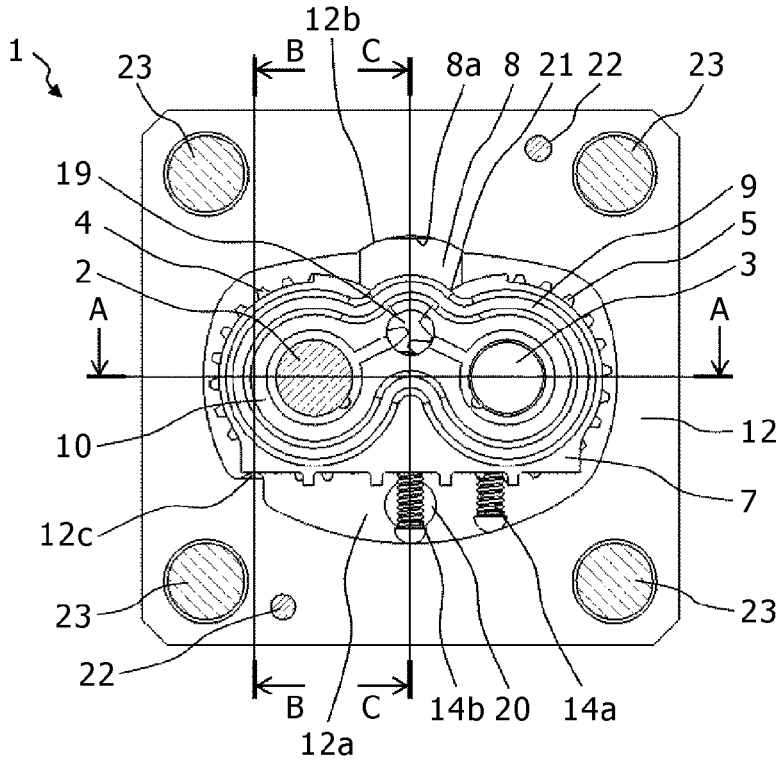
FIG. 1 is a cross-sectional view illustrating a basic configuration of a gear pump according to a first embodiment of the present invention, in a direction orthogonal to a drive shaft.
Figure 2:
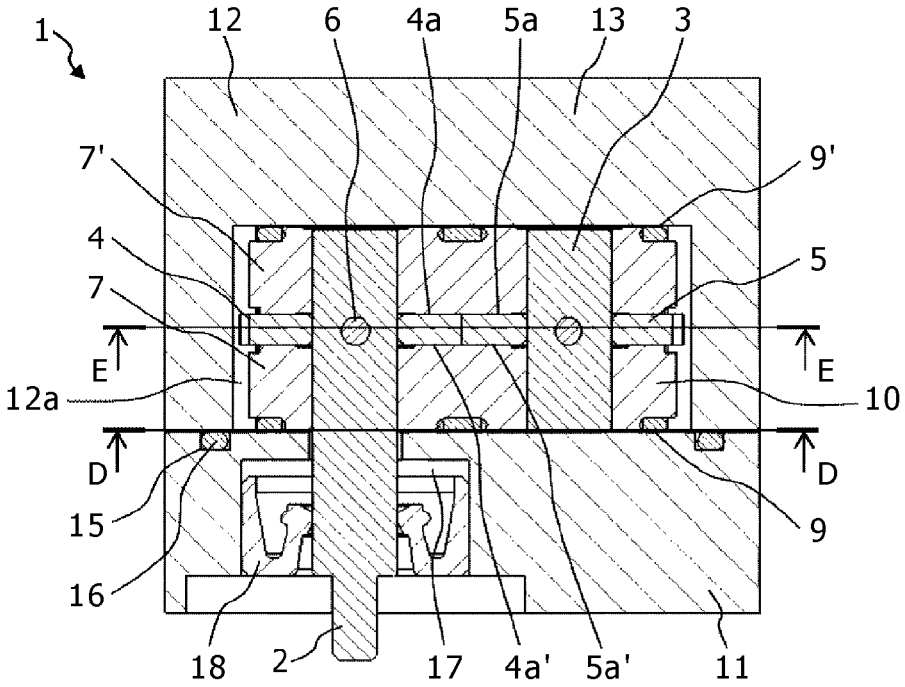
FIG. 2 is a cross-sectional view taken along a line A-A of the gear pump illustrated in FIG. 1.
Figure 3:
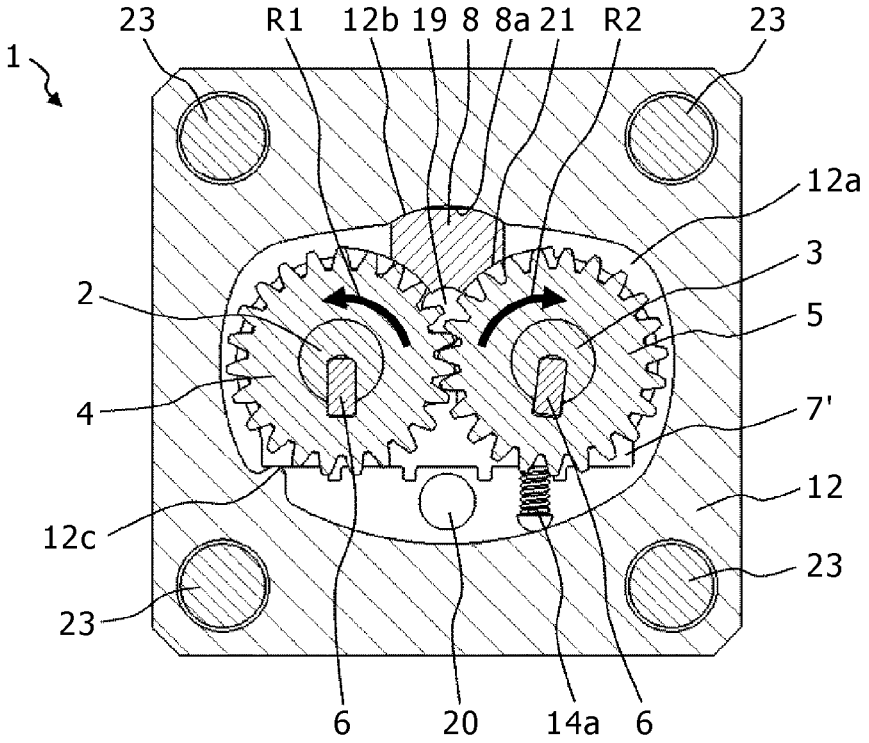
FIG. 3 is a cross-sectional view taken along a line E-E of the gear pump illustrated in FIG. 2.
Figure 4:
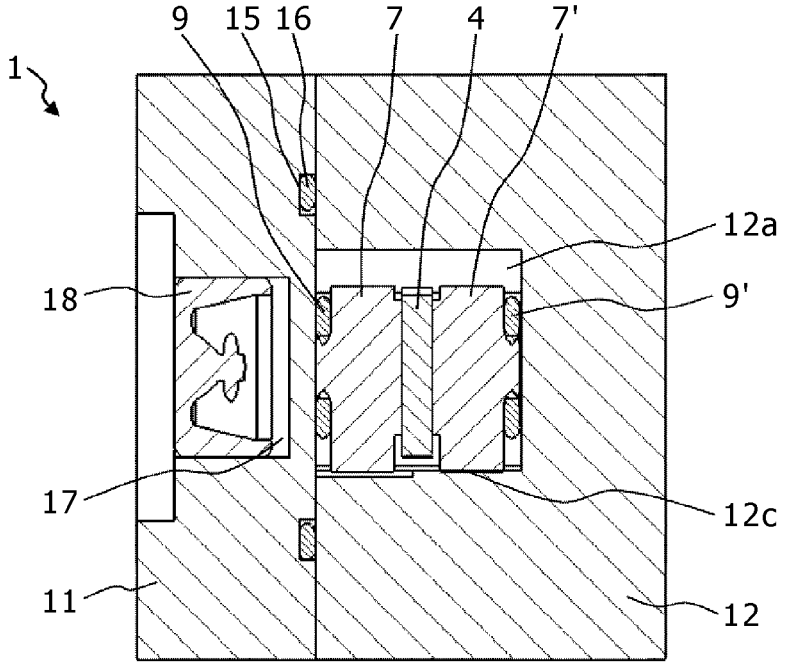
FIG. 4 is a cross-sectional view taken along a line B-B of the gear pump illustrated in FIG. 1.
Figure 5:
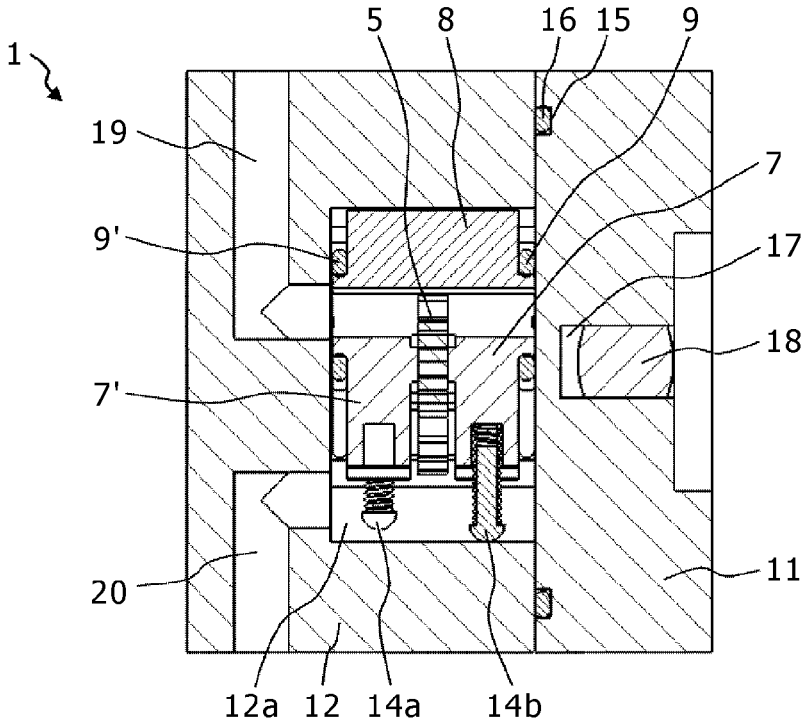
FIG. 5 is a cross-sectional view taken along a line C-C of the gear pump illustrated in FIG. 1.

FIG. 1 is a cross-sectional view illustrating a basic configuration of a gear pump according to a first embodiment of the present invention, in a direction orthogonal to a drive shaft. FIG. 2 is a cross-sectional view taken along a line A-A of the gear pump illustrated in FIG. 1, FIG. 3 is a cross-sectional view taken along a line E-E of the gear pump illustrated in FIG. 2, FIG. 4 is a cross-sectional view taken along a line B-B of the gear pump illustrated in FIG. 1, and FIG. 5 is a cross-sectional view taken along a line C-C of the gear pump illustrated in FIG. 1. FIG. 1 corresponds to a cross-sectional view taken along a line D-D of the gear pump illustrated in FIG. 2.

Hereinafter, a description will be given of a gear pump 1 according to a first embodiment of the present invention with reference to FIGS. 1 to 5.

As illustrated in FIG. 1, the gear pump 1 includes a pump assembly 10. The pump assembly 10 includes a drive shaft (drive shaft) 2, a driven shaft (driven shaft) 3, a pair of gears 4, 5, drive pins 6, a pair of side plates 7, 7', and a seal block 8.

The drive shaft 2 is connected to an external drive source not shown, and rotationally driven. The driven shaft 3 receives a rotating force from the drive shaft 2 through the pair of gears 4 and 5, and rotates. As illustrated in FIG. 2, the pair of gears 4 and 5 is supported the drive shaft 2 and the driven shaft 3, respectively, and the respective addendums of the gears 4 and 5 mesh with each other. As illustrated in FIG. 3, the respective drive pins 6 are inserted into those shafts 2 and 3 so that the drive shaft 2 and the driven shaft 3 rotate integrally with the gears 4 and 5, respectively. The pair of side plates 7 and 7' are arranged adjacent to both side surfaces of the gears 4 and 5 as illustrated in FIGS. 2 and 4, and have an abutment surface 21 that abuts against the seal block 8 as illustrated in FIG. 1. The seal block 8 abuts the side plates 7 and 7' on the abutment surface 21 as illustrated in FIG. 1, and covers a part of the gears 4 and 5 in a circumferential direction as illustrated in FIGS. 3 and 5. That is, the seal block 8 comes close to the addendums of the gears 4 and 5 in a given area in the circumferential directions of the gears 4 and 5.

As illustrated in FIG. 2, the side plate 7 is arranged adjacent to a side surface 4*a*' of the gear 4 and a side surface 5*a*' of the gear 5, and the side plate 7' is arranged adjacent to a side surface 4*a* of the gear 4 and a side surface 5*a* of the gear 5. The side plate 7 comes in slide contact with the side surfaces 4*a*' and 5*a*' of the gears 4 and 5, and the side plate 7' comes in slide contact with the side surfaces 4*a* and 5*a* of the gears 4 and 5 whereby the side plates 7 and 7' seal both side surfaces of the gears 4 and 5.

The side plates 7 and 7' each have two through-holes. The drive shaft 2 and the driven shaft 3 pass through the through-holes of the side plates 7 and 7' with the results that both shafts of the drive shaft 2 and the driven shaft 3 are supported in parallel to each other and at a given interval. Those through-holes also function as bearings.

The side plates 7 and 7' have substantially the same configuration, and have a suction port 19 forming a suction flow hole as illustrated in FIG. 1. Also, as illustrated in FIG. 3, the outer edges of the side plates 7 and 7' close to the suction port 19 are approximately equal in shape to the outlines of circles formed by the addendums of the gears 4 and 5. That is, the outer edges of the side plates 7 and 7' close to the suction port 19 each have an arc shape.

Also, as illustrated in FIG. 3, side surfaces of the seal block 8 opposite to the gears 4 and 5 have substantially the same configurations as those of the arc-shaped portions of the side plates 7 and 7'. As described above, the seal block 8 and the side plates 7, 7' come in close contact with each other on the abutment surface 21 of the side plates 7 and 7'.

As illustrated in FIG. 2, the pump assembly 10 is accommodated in a housing 13 having a front case 11 and a rear case 12. The front case 11 and the rear case 12 are formed of members different from the seal block 8. As illustrated in FIGS. 1 to 5, the rear case 12 has a recess 12*a*. As illustrated in FIGS. 2, 4, and 5, the front case 11 is fitted to an open end of the recess 12*a* to form a space for sealing liquid.

As illustrated in FIGS. 2, 4, and 5, seal members 9 and 9' are installed on both of end surfaces of the pump assembly 10 in a direction of extending the drive shaft 2, and the pump assembly 10 is held between the front case 11 and the rear case 12 through the seal members 9 and 9'. The front case 11 and the rear case 12 positionally match each other by dowel pins 22 illustrated in FIG. 1, and fastened to each other with bolts 23.

The recess 12*a* of the rear case has, for example, a configuration illustrated in FIGS. 1 and 3, and accommodates a part of the drive shaft 2, the driven shaft 3, the gears 4, 5, the side plates 7, 7', and the seal block 8 as illustrated in FIGS. 1 to 5.

As illustrated in FIGS. 1 and 3, a surface 12*b* of a recess 12*a* of the rear case facing the seal block 8 has a cylindrical surface. A surface 8*a* of the seal block 8 facing the recess 12*a* of the rear case also has a cylindrical surface. Hereinafter, the surface 12*b* of the recess 12*a* of the rear case facing the seal block 8 is called "facing surface 12*b* of the rear case recess", and the surface 8*a* of the seal block 8 facing the recess 12*a* of the rear case is called "facing surface 8*a* of the seal block". The facing surface 12*b* of the rear case recess, and the facing surface 8*a* of the seal block face each other.

The facing surface 12*b* of the rear case recess has a cylindrical surface that is equal in curvature to the facing surface 8*a* of the seal block, or larger in curvature than the facing surface 8*a* of the seal block. With this configuration, the facing surface 12*b* of the rear case recess and the facing surface 8*a* of the seal block can come in contact with each other in at least two places. The pump assembly 10 rotates due to a reaction moment generated when the drive shaft 2 rotationally drives the gear 4, and a center of the rotation is determined according to the facing surface 12*b* of the rear case recess. That is, with a line that passes through a center of an arc of the facing surface 12*b* of the rear case recess which is the cylindrical surface, and is in parallel to the drive shaft 2 as a rotating axis, the pump assembly 10 rotates about the rotating axis. In this situation, the facing surface 12*b* of the rear case recess and the facing surface 8*a* of the seal block come in contact with each other in at least two places with the results that the pump assembly 10 is held to be rotatable about the rotating axis.

The rotating axis of the pump assembly 10 passes through the center of the arc of the facing surface 12*b* of the rear case recess, and is in parallel to the drive shaft 2. Therefore, the rotating axis of the pump assembly 10 in FIG. 1 is located between a position of the drive shaft 2 and a position of the driven shaft 3 in a direction (horizontal in FIG. 1) connecting the drive shaft 2 and the driven shaft 3, and located below the facing surface 8*a* of the seal block in a direction (horizontal direction in FIG. 1) perpendicular to the direction connecting the drive shaft 2 and the driven shaft 3, and an extending direction (vertical direction in FIG. 1) of the drive shaft 2.

As illustrated in FIGS. 1 and 3, a projecting portion 12*c* is disposed on an inner wall of the recess 12*a* of the rear case 12 in one place. In FIGS. 1 and 3, as an example, the projecting portion 12*c* is located across the drive shaft 2 from the rotating axis of the pump assembly 10 in the direction connecting the drive shaft 2 and the driven shaft 3 (horizontal direction in FIGS. 1 and 3), that is, located on a bottom left of the drive shaft 2.

As illustrated in FIG. 3, the projecting portion 12*c* comes in contact with one of the two side plates 7 and 7' (in FIG. 4, side plate 7' at a side farther from the front case 11), and the pump assembly 10, and the pump assembly 10 is prevented from rotating about the above-mentioned rotating axis. A portion of the side plate 7' located across the drive shaft 2 from the rotating axis of the pump assembly 10 in the direction (horizontal direction in FIGS. 1 and 3) connecting the drive shaft 2 and the driven shaft 3 comes in contact with the projecting portion 12*c* of the recess 12*a* in the rear case 12.

Also, as illustrated in FIGS. 1 and 5, urging mechanisms 14*a* and 14*b* are disposed in order to press the side plates 7 and 7' toward a direction where the seal block 8 is located. The urging mechanisms 14*a* and 14*b* are formed of elastic members which are each formed of, for example, a spring and a pin. As illustrated in FIGS. 1 and 5, the urging mechanisms 14*a* and 14*b* are arranged between the side plates 7, 7', and the inner wall of the recess 12*a*.

As illustrated in FIG. 3, the urging mechanism 14*a* presses the side plate 7', and rotates the pump assembly 10 in the same direction as a rotating direction R1 of the drive shaft 2 and the gear 4. That is, the urging mechanism 14*a* is located (at a right side in FIG. 3) across the rotating axis of the pump assembly 10 from a position (left side in FIG. 3) of the projecting portion 12*c* in the direction connecting the drive shaft 2 and the driven shaft 3 (horizontal direction in FIG. 3) to press the side plate 7'. The side plate 7' is supported by the projecting portion 12*c* of the recess 12*a* in the rear case 12 as described above.

As illustrated in FIG. 1, the urging mechanism 14*b* is located (lower side in FIG. 3) across the rotating axis of the pump assembly 10 from the position (upper side in FIG. 3) of the seal block 8 in the direction (vertical direction in FIG. 1) perpendicular to the direction connecting the drive shaft 2 and the driven shaft 3, and an extending direction of the drive shaft 2 (vertical direction in FIG. 1) to press the side plate 7.

With the configuration illustrated FIGS. 1 to 5, the pump assembly 10 is accommodated within the recess 12*a* of the rear case 12 so as to be rotatable about the rotating axis. The rotation of the pump assembly 10 is suppressed by allowing the urging mechanism 14*a* to press the side plate 7' toward the projecting portion 12*c* of the recess 12*a* of the rear case 12. As a result, the pump assembly 10 is positionally determined within the recess 12*a* of the rear case 12. Also, the side plate 7 is pressed by the urging mechanism 14*b* without contacting with the recess 12*a* of the rear case 12, and positionally fixed in a state where the side plate 7 comes in close contact with the seal block 8 on the abutment surface 21.

With the above configuration, one side plate 7' serves to fix the position of the pump assembly 10, and the other side plate 7 is fixed by contacting with the fixed seal block 8. For that reason, even if a configuration of the abutment surface 21 with the seal block 8 is slightly different between the side plates 7 and 7', one side plate does not inhibit a close contact between the other side plate and the seal block 8.

Also, as illustrated in FIGS. 2, 4, and 5, the front case 11 has grooves 15 in the contact surface with the rear case 12. Case seals 16 are arranged in the respective grooves 15. The front case 11 is fitted to the rear case 12 in such a state. The case seals 16 seal a gap that may be generated between the front case 11 and the rear case 12 when the front case 11 and the rear case 12 are combined together so that liquid within the rear case 12 is prevented from leaking into the external.

Also, as illustrated in FIGS. 2, 4, and 5, in the front case 11, a recess 17 is disposed in a surface (for example, lower surface in FIG. 2) on a side opposite to the contact surface with the rear case 12. An oil seal 18 is disposed in the recess 17. The oil seal 18 is fitted into the recess 17 of the front case 11, and an outer peripheral surface of the oil seal 18 comes in close contact with the wall surface of the recess 17, and an inner peripheral surface of the oil seal 18 comes in slide contact with the outer peripheral surface of the drive shaft 2. With this configuration, the oil seal 18 seals the gap formed between the drive shaft 2 and the front case 11, and prevents the liquid within a pump chamber from being leaked to the external when driving the gear pump.

As illustrated in FIG. 5, the suction port 19 is formed by the side plates 7, 7', the seal block 8, and the rear case 12. Also, a discharge port 20 is formed by a flow path formed in the rear case 12. As illustrated in FIGS. 1, 3, and 5, the discharge port 20 communicates with the recess 12*a* of the rear case 12 as illustrated in FIGS. 1, 3, and 5.

A tank (not shown) that supplies liquid into the gear pump 1 is connected to an upstream side of the suction port 19. A valve or a cylinder (not shown) is connected to a downstream side of the discharge port 20 to regulate a pump discharge pressure. Also, the drive shaft 2 is connected with a drive source (not shown) such as a motor.

When driving the gear pump 1, a high pressure region and a low pressure region are formed in the recess 12*a* of the rear case 12. The high pressure region and the low pressure region are partitioned by the respective parts described below. Sealing by those respective parts will be described. The gear pump 1 is portioned and sealed by a meshing portion of the gears 4 and 5, slide contact surfaces of the addendums of the gears 4, 5, and the seal block 8, slide contact surfaces of the side surfaces 4*a*, 4*a'*, 5*a*, 5*a'* of the gears 4 and 5, and the side plates 7, 7', abutment surfaces of the seal block 8 and the side plates 7, 7', and the seal members 9, 9' installed between the front case 11 and the rear case 12 so that liquid does not flow when a pressure difference is generated between a periphery of the suction port 19 and a periphery of the discharge port 20.

Then, the operation of the gear pump 1 according to this embodiment will be described. The drive shaft 2 is driven by the drive source such as a motor not shown as described above. The gear 4 is supported to rotate integrally with the drive shaft 2. For that reason, when the drive shaft 2 rotates in the rotating direction R1 illustrated in FIG. 3, the gear 4 also rotates in the rotating direction R1. The gear 5 meshes with the gear 4 by the respective addendums thereof, and rotates integrally with the driven shaft 3. For that reason, when the gear 4 rotates in the rotating direction R1, the gear 5 rotates integrally with the driven shaft 3 in a rotating direction R2.

When the meshed teeth of the gears 4 and 5 is disengaged from each other due to the rotation, a volume of a space around the suction port 19 increases, as a result of which liquid is sucked from the suction port 19. The liquid around the suction port 19 is accommodated in tooth spaces of the gears 4 and 5, and conveyed along the rotating directions R1 and R2 of the gears 4 and 5, by the rotations of the gears 4 and 5. The conveyed liquid flows out of the tooth spaces with the rotation of the gears 4 and 5.

As described above, the liquid does not flows in the periphery of the suction port 19 of the gear pump 1, and the periphery of the discharge port 20 due to the sealing of the respective parts. For that reason, a pressure increases in the periphery of the discharge port 20 due to the liquid flowed out of the tooth spaces, and the liquid is discharged from the discharge port 20.

The above operation is continuously conducted, as a result of which in the gear pump 1, only the inside of the seal members 9 and 9' becomes low pressure, and the other portions become high pressure.

In the gear pump 1 according to the first embodiment, the pump assembly 10 is fixed to the recess 12*a* of the rear case 12 in the above method. When the gear pump 1 is driven, the pump assembly 10 receives a force for rotating in the same direction as the rotating direction R1 of the drive shaft 2 in the recess 12*a* of the rear case 12 due to an influence of the meshing reaction of the gears 4 and 5, or an influence of a frictional force between the side surfaces of the gears 4, 5 and the side plates 7, 7'. However, in the pump assembly 10, the facing surface 12*b* of the rear case recess comes in contact with the facing surface 8*a* of the seal block in at least two places, and the projecting portion 12*c* of the recess 12*a* in the rear case 12 comes in contact with one side plate 7' in one place. That is, the pump assembly 10 comes in contact with the rear case 12 in at least three places. For that reason, the pump assembly 10 can be stably fixed to the recess 12*a* of the rear case 12.

It is desirable that a position at which the side plate 7' comes in contact with the rear case 12, that is, the position of the projecting portion 12*c* is set to a position as far as possible from the rotating axis of the pump assembly 10 (for example, position of the inner wall at the lower left as much as possible in the recess 12*a* of the rear case 12 in FIG. 1) because the stability in the operation increases.

In the gear pump 1 according to the first embodiment, the position of the pump assembly 10 is determined by the above method. For that reason, the bearings for supporting the drive shaft 2 and the driven shaft 3 do not need to be provided in the front case 11 and the rear case 12, but have only to be provided in only the side plates 7 an 7' (as already described above, the through-holes formed in the side plates 7 and 7' form the bearings).

Therefore, there is no case in which the drive shaft 2 becomes overstrained by provision of the bearings in the front case 11 and the rear case 12 as in the conventional gear pump. Also, there is no need to take measure for avoiding the overstraining such that the gaps between the bearings of the side plates 7 and 7', and the drive shaft 2 are set to be larger than the gaps between the bearings of the front case 11 and the rear case 12, and the drive shaft 2. Further, since the drive shaft 2 and the driven shaft 3 are supported by the bearings in the side plates 7 and 7' adjacent to the gears 4 and 5, the deflection of the shafts caused by the pressure when driving the gear pump 1 can be reduced. In the high pressure discharge operation, the addendums of the gears 4 and 5 slide on the seal block 8 to reduce the amount of scraping. For the above reasons, the difference in the gaps between the addendums of the gears 4 and 5 and the seal block 8 can be reduced. For that reason, liquid leakage from the high pressure side to the low pressure side through the seal surface between the addendums of the gears 4 and 5 and the seal block 8 can be reduced.

When the bearings are installed in the housing 13 to prevent overstraining, and the amount of scraping the seal block 8 by the addendums of the gears 4 and 5 is suppressed in the high pressure state, the machining process of the respective parts configuring the pump assembly 10, and the assembling precision when the pump assembly 10 is assembled with the front case 11 and the rear case 12 are highly required, resulting in a possibility that the costs increase.

In the gear pump 1 according to this embodiment, because the bearings are not installed in the housing 13 as described above, high precision is not required for assembling the pump assembly 10 with the front case 11 and the rear case 12, and high-efficiency pump can be realized by merely considering the machining precision of the parts configuring the pump assembly 10. For that reason, the gear pump 1 according to this embodiment is easy in assembling and the costs can be reduced.

Figure 6:
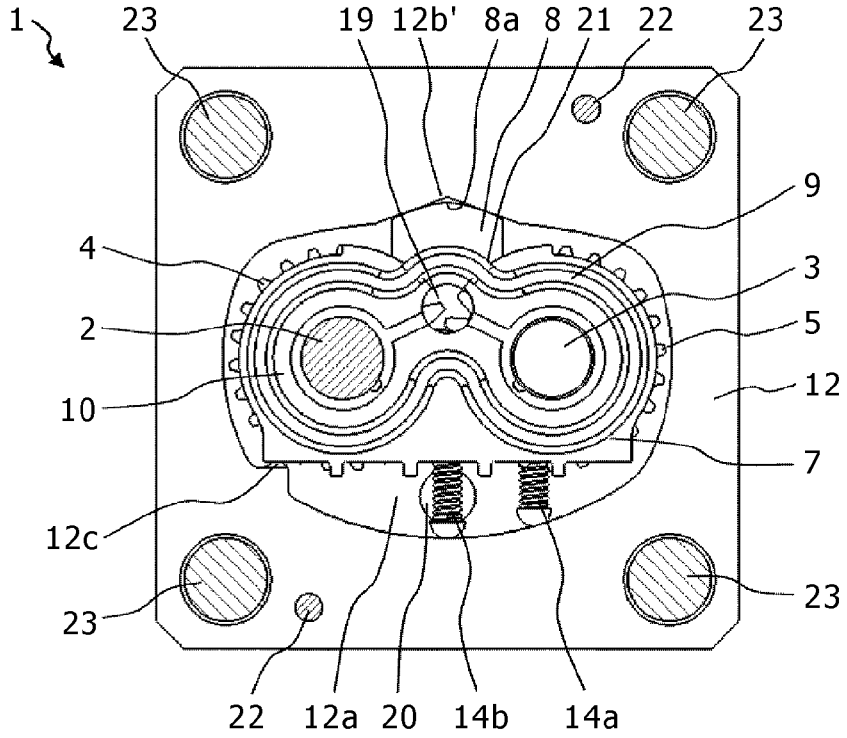
FIG. 6 is a cross-sectional view illustrating the basic configuration of the gear pump according to the first embodiment of the present invention, in the direction orthogonal to the drive shaft, which illustrates an example of another shape of a facing surface of a rear case recess.
Figure 7:
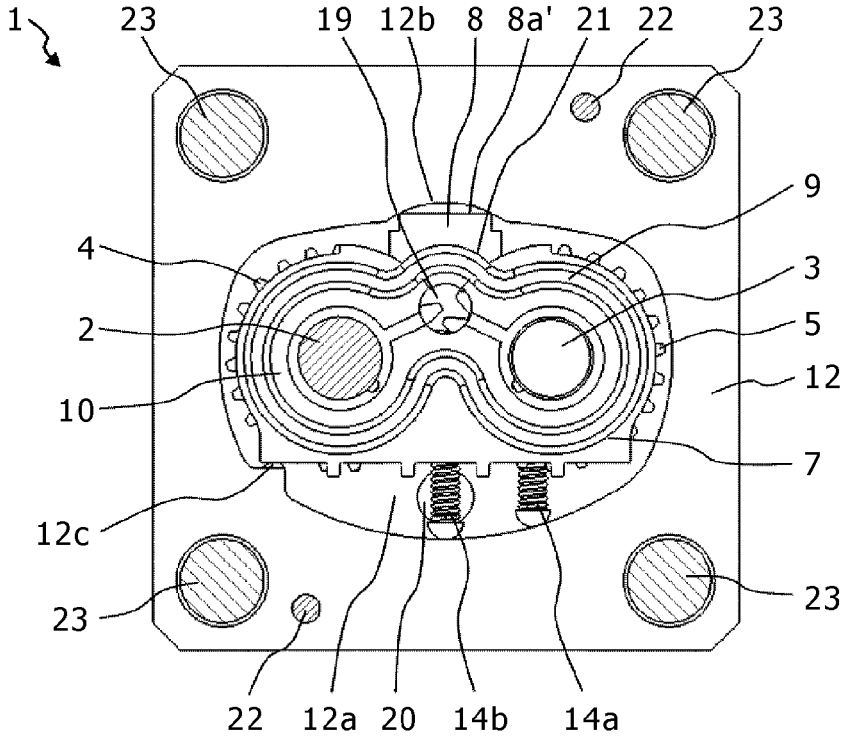
FIG. 7 is a cross-sectional view illustrating the basic configuration of the gear pump according to the first embodiment of the present invention, in the direction orthogonal to the drive shaft, which illustrates an example of another shape of a facing surface of a seal block.
Figure 8:
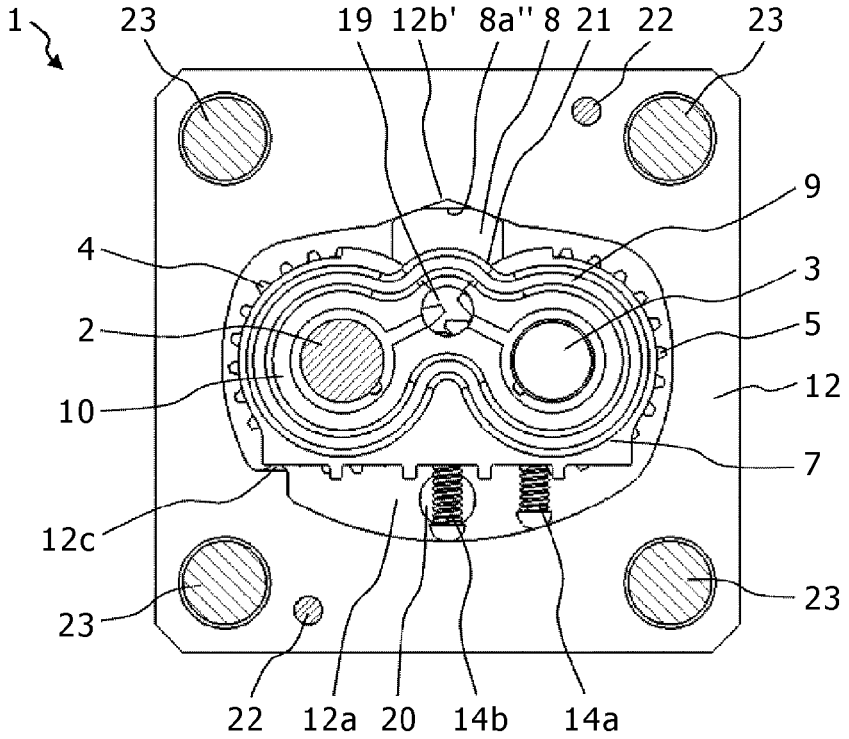
FIG. 8 is a cross-sectional view illustrating the basic configuration of the gear pump according to the first embodiment of the present invention, in the direction orthogonal to the drive shaft, which illustrates an example of another shape of the facing surface of the rear case recess and the facing surface of the seal block.

Also, in this embodiment as illustrated in FIGS. 1 to 5, the facing surface 12*b* of the rear case recess and the facing surface 8*a* of the seal block have the cylindrical surfaces, however, those surfaces may not be of the cylindrical surfaces. An example in which the facing surface 12*b* of the rear case recess and the facing surface 8*a* of the seal block have the cylindrical surfaces are not of the cylindrical surfaces will be described with reference to FIGS. 6 to 8. In FIGS. 6 to 8, the same symbols as those in FIGS. 1 to 5 indicate the same as or common elements to those in FIGS. 1 to 5, and a description of those elements will be omitted.

FIG. 6 is a cross-sectional view along a direction perpendicular to the drive shaft 2 of the gear pump 1 (cross-sectional view at the same position as that illustrated in FIG. 1), which is a diagram illustrating an example in which the facing surface 12*b*' of the rear case recess is not of the cylindrical surface. The facing surface 12*b*' of the rear case recess in the gear pump 1 illustrated in FIG. 6 is shaped to have two plane surfaces forming a V-shape, and projects from the seal block 8 toward the outside of the rear case 12. The facing surface 8*a* of the seal block is of a cylindrical surface.

Even if the facing surface 12*b*' of the rear case recess has the above shape, the facing surface 12*b*' of the rear case recess and the facing surface 8*a* of the seal block come in contact with each other in at least two places with the results that the pump assembly 10 is held to be rotatable about the rotating axis. However, the rotating axis in this case is a line that passing through the arc center of the cylindrical surface which is inscribed in the facing surface 12*b*' of the rear case recess, and is parallel to the drive shaft 2. Therefore, even in the configuration illustrated in FIG. 6, the same advantages as those in the configuration illustrated in FIGS. 1 to 5 are obtained.

FIG. 7 is a cross-sectional view along a direction perpendicular to the drive shaft 2 of the gear pump 1 (cross-sectional view at the same position as that illustrated in FIG. 1), which is a diagram illustrating an example in which the facing surface 8*a*' of the seal block is not of the cylindrical surface. The facing surface 8*a*' of the seal block in the gear pump 1 illustrated in FIG. 7 has a planar shape, and comes in contact with the facing surface 12*b* of the rear case recess at an end of the plane surface.

Even if the facing surface 8*a*' of the seal block has the above shape, the facing surface 12*b* of the rear case recess and the facing surface 8*a*' of the seal block come in contact with each other in at least two places with the results that the pump assembly 10 is held to be rotatable about the rotating axis. Therefore, even in the configuration illustrated in FIG. 7, the same advantages as those in the configuration illustrated in FIGS. 1 to 5 are obtained.

FIG. 8 is a cross-sectional view along a direction perpendicular to the drive shaft 2 of the gear pump 1 (cross-sectional view at the same position as that illustrated in FIG. 1), which is a diagram illustrating an example in which both of the facing surface 12*b*' of the rear case recess and the facing surface 8*a*" of the seal block are not of the cylindrical surface. The facing surface 12*b*' of the rear case recess in the gear pump 1 illustrated in FIG. 8 is shaped to have two plane surfaces forming a V-shape as in FIG. 6. The facing surface 8*a*" of the seal block in the gear pump 1 illustrated in FIG. 8 is shaped to have three plane surfaces, and includes two plane surfaces that contact with the facing surface 12*b*' of the rear case recess, and one plane surface located between those plane surfaces.

Even if the facing surface 12*b*' of the rear case recess and the facing surface 8*a*" of the seal block have the above respective shapes, the facing surface 12*b*' of the rear case recess and the facing surface 8*a*" of the seal block come in contact with each other in at least two places with the results that the pump assembly 10 is held to be rotatable about the rotating axis. However, the rotating axis in this case is a line that passing through the arc center of the cylindrical surface which is inscribed in the facing surface 12*b*' of the rear case recess, and is parallel to the drive shaft 2. Therefore, even in the configuration illustrated in FIG. 8, the same advantages as those in the configuration illustrated in FIGS. 1 to 5 are obtained.

As described above, the shapes of the facing surface of the rear case recess and the facing surface of the seal block may not be of the cylindrical surfaces, and may include a plane surface. Also, those facing surfaces may be shaped to include the curvature other than the cylindrical surface. For example, the facing surface of the seal block may be shaped to include two curved surfaces that come in contact with the facing surface of the rear case recess, and one plane surface located between those curved surfaces. That is, the facing surface of the rear case recess and the facing surface of the seal block include one or both of the curved surface and the plane surface. However, when the facing surface of the rear case recess is formed by only the plane surface, in order to hold pump assembly 10 so as to be rotatable around the rotating axis, for example, as illustrated in FIGS. 6 and 8, the facing surface of the rear case recess needs to be formed of plural plane surfaces.

In all of those shapes, the facing surface of the rear case recess and the facing surface of the seal block come in contact with each other in at least two places with the results that the pump assembly 10 is held to be rotatable about the rotating axis. The rotating axis of the pump assembly 10 is a line that passing through the arc center of the cylindrical surface which is inscribed in the facing surface of the rear case recess, and is parallel to the drive shaft 2. Because the projecting portion 12*c* of the recess 12*a* in the rear case 12 comes in contact with the side plate 7', the rotation of the pump assembly 10 is suppressed. In this way, because the pump assembly 10 comes in contact with the rear case 12 in at least three places, the pump assembly 10 can be stably fixed to the recess 12*a* of the rear case 12.

Also, in the example illustrated in FIG. 4, the projecting portion 12*c* of the recess 12*a* in the rear case 12 is formed by directly machining the rear case 12. Alternatively, the projecting portion 12*c* may be formed on the rear case 12 by another method.

Figure 9:
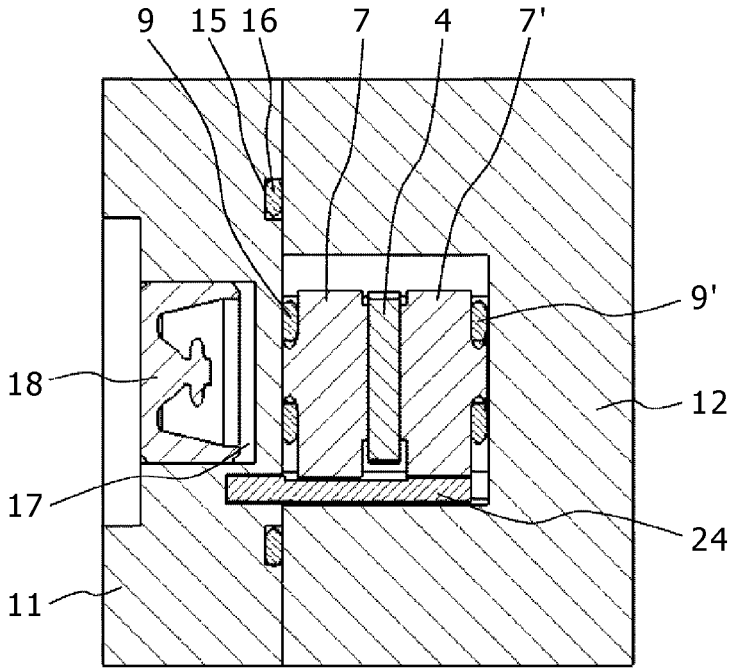
FIG. 9 is a cross-sectional view taken along a line B-B of the gear pump illustrated in FIG. 1, which illustrates an example of providing a projecting portion of a recess of the rear case according to another method.

FIG. 9 is a cross-sectional view taken along a line B-B of the gear pump illustrated in FIG. 1, as in FIG. 4, which illustrates an example of providing a projecting portion in the recess 12*a* in the rear case 12 according to another method. In FIG. 9, the same symbols as those in FIGS. 1 to 5 indicate the same as or common elements to those in FIGS. 1 to 5, and a description of those elements will be omitted.

In FIG. 9, an anti-rotation pin 24 is pressed into the front case 11 and the rear case 12 as another part, and functions as a projecting portion of the recess 12*a* in the rear case 12. Since the anti-rotation pin 24 comes in contact with the side plate 7', even with this configuration, the same advantages as those in the configuration illustrated in FIGS. 1 to 5 are obtained.

As described above, it is desirable that the projecting portion of the recess 12*a* in the rear case 12 is located at a position as far as possible from the rotating axis of the pump assembly 10. However, the projecting portion of the recess 12*a* in the rear case 12 has only to be located at a position where the rotation of the pump assembly 10 stops, and even at this position, substantially the same advantages can be obtained even if the recess 12*a* of the rear case is provided in any portion.

Second Embodiment

Figure 10:
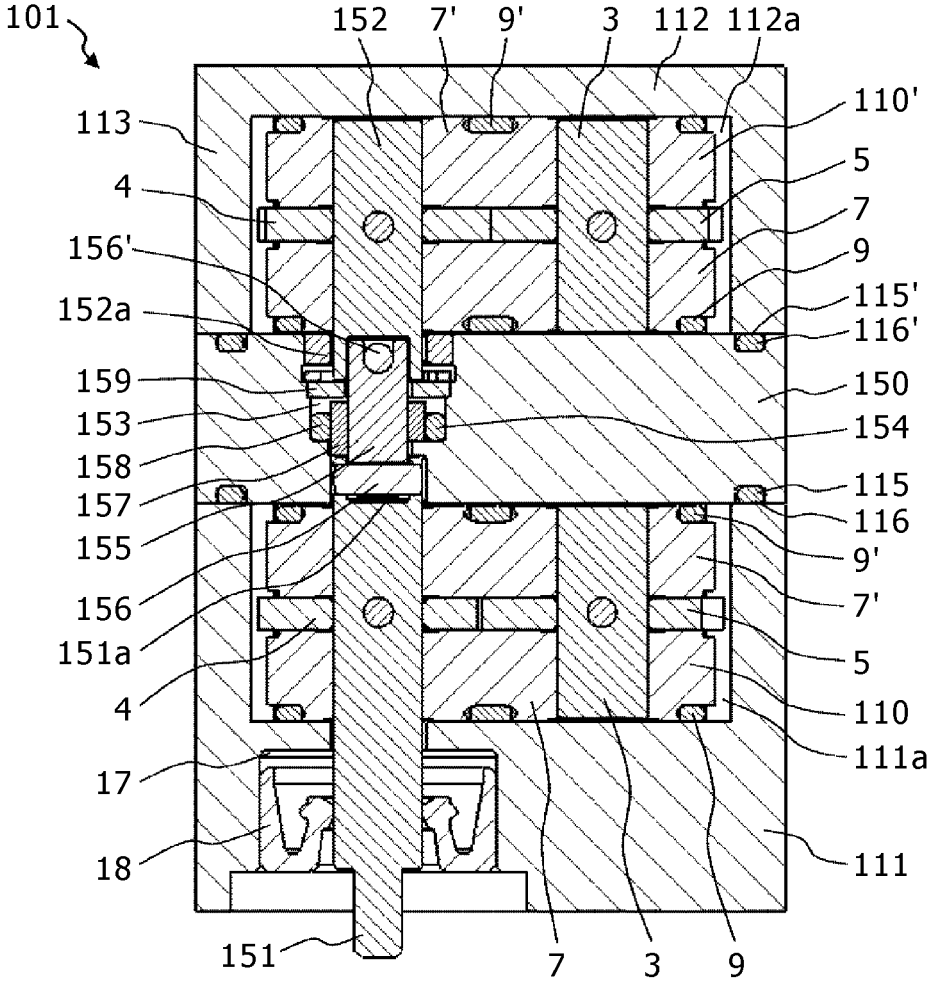
FIG. 10 is a diagram illustrating a configuration of a gear pump according to a second embodiment of the present invention, which is a cross-sectional view in a direction parallel to the drive shaft (corresponding to a cross-section A-A in FIG. 1).

FIG. 10 is a diagram illustrating a configuration of a gear pump according to a second embodiment of the present invention, which is a cross-sectional view in a direction parallel to a drive shaft (drive shaft). A gear pump 101 according to the second embodiment is configured to array two gear pumps 1 of the first embodiment in series, and to drive those gear pumps 1 by a single drive source. As in FIG. 2, FIG. 10 corresponds to the cross-section taken along a line A-A in FIG. 1. In the gear pump 101, a cross-sectional view other than the cross-section illustrated in FIG. 10 and a configuration of the pump assembly are identical with those in the first embodiment. For that reason, in the second embodiment, the same or common elements as/to those in the first embodiment are denoted by the identical symbols with those used in the first embodiment, and a detailed description thereof will be omitted.

As illustrated in FIG. 10, the gear pump 101 includes two pump assemblies 110 and 110'. The pump assemblies 110 and 110' each have the same configuration as that of the pump assembly 10 described in the first embodiment, and are aligned in series in an extending direction of the drive shaft.

The gear pump 101 includes a front case 111 and a rear case 112. The front case 111 and the rear case 112 have recesses 111*a* and 112*a*, respectively. The recesses 111*a* and 112*a* have the same configuration as that of the recess 12*a* in the rear case 12 described in the first embodiment, and accommodate the pump assemblies 110 and 110', respectively.

The gear pump 101 further includes a center plate 150. The center plate 150 is fitted to open ends of the front case 111 and the rear case 112, and includes grooves 115 in a contact surface with the front case 111, and grooves 115' in a contact surface with the rear case 112, respectively. The grooves 115 and 115' have the same shape as the grooves 15 of the front case 11 in the first embodiment. The grooves 115 and 115' are equipped with case seals 116 and 116', respectively.

A housing 113 includes the front case 111, the rear case 112, and the center plate 150. The front case 111, the rear case 112, and the center plate 150 are joined to each other by fastening using volts or welding.

The pump assembles 110 and 110' are driven by a common drive source. The pump assembly 110 is driven by a front drive shaft 151, and the pump assemble 110' is driven by a rear drive shaft 152, instead of the drive shaft 2 described in the first embodiment.

The center plate 150 has a through-hole 153, and a joint 154 is accommodated in the joint 154. The joint 154 includes a joint shaft 155, and connects the front drive shaft 151 and the rear drive shaft 152. The joint shaft 155 transmits a drive force of a drive source (not shown) connected to a tip of the front drive shaft 151 to the rear drive shaft 152. The joint 154 can be formed of, for example, a universal joint.

A joint pin 156 is inserted into the front drive shaft 151, and a joint pin 156' is inserted into the rear drive shaft 152. The joint pins 156 and 156' are orthogonal to each other, and inserted orthogonally into the front drive shaft 151 and the rear drive shaft 152.

Figure 11:
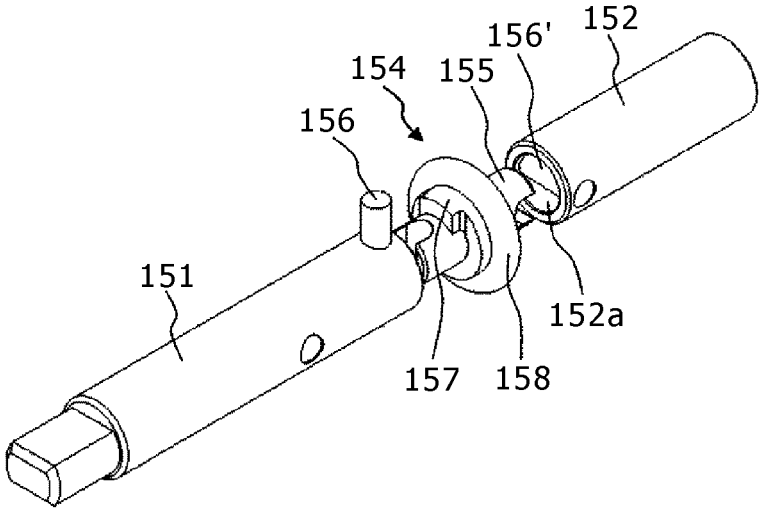
FIG. 11 is a diagram illustrating a front drive shaft, a rear drive shaft, and a joint extracted from FIG. 10.

FIG. 11 is a diagram illustrating the front drive shaft 151, the rear drive shaft 152, and the joint 154 extracted from FIG. 10. In FIG. 11, the same symbols as those in FIG. 10 indicate the same as or common elements to those in FIG. 11, and a description of those elements will be omitted. In FIG. 11, the joint pin 156 inserted into the front drive shaft 151 is extracted for description.

As illustrated in FIGS. 11 and 10, the joint 154 can transmit a power of the drive source from the front drive shaft 151 to the rear drive shaft 152 by the joint shaft 155, and the joint pins 156, 156'.

As illustrated in FIG. 10, a hole 151*a* is formed in an end of the front drive shaft 151, and a hole 152*a* is formed in an end of the rear drive shaft 152. A leading end of the joint shaft 155 is inserted into the hole 151*a* and the hole 152*a*. Inner diameters of the hole 151*a* and the hole 152*a* are set to be larger than an outer diameter of the joint shaft 155. With this configuration, the joint shaft 155 can be inclined around the joint pins 156 and 156' within gaps between the joint shaft 155, and the hole 151*a*, the hole 152*a*.

Also, the joint 154 includes a joint collar 157, a joint seal 158, and a joint washer 159. The joint collar 157 comes in slide contact with an outer periphery of the joint shaft 155, and is installed to disable rotation relative to the center plate 150. The joint seal 158 is arranged to come in contact with an outer periphery of the joint collar 157, and an inner periphery of the through-hole 153 in the center plate 150. The joint washer 159 configures a wall surface of the joint seal 158.

A gap between the joint shaft 155 and the joint collar 157, and a gap between the joint collar 157 and the through-hole 153 of the center plate 150 are sealed by the joint collar 157, the joint seal 158, and the joint washer 159. With this sealing, liquid within the recess 111*a* in the front case 111 is prevented from being mixed with liquid within the recess 112*a* of the rear case 112.

In the gear pump 101 according to the second embodiment, as in the gear pump 1 described in the first embodiment, the pump assemble 110 is accommodated within the recess 111*a* of the front case 111 so as to be rotatable about the rotating axis, and comes in contact with the front case 111 in at least three places. The pump assemble 110' is accommodated within the recess 112*a* of the rear case 112 so as to be rotatable about the rotating axis, and comes in contact with the rear case 112 in at least three places. For that reason, the pump assemble 110 and the pump assemble 110' can be stably fixed to the recess 111*a* of the front case 111 and the recess 112*a* of the rear case 112. The rotating axes of the pump assemble 110 and the pump assemble 110' can be determined in the same manner as the rotating axis of the pump assembly 10 described in the first embodiment.

The above-mentioned joint 154 a torque transmission mechanism that can absorb the coaxial deviation of the front drive shaft 151 and the rear drive shaft 152 from each other, and can transmit only a torque from the front drive shaft 151 to the rear drive shaft 152. For that reason, the gear pump 101 according to the second embodiment does not require high precision in assembly as with the gear pump 1 described in the first embodiment.

Any one of liquid within the recess 111*a* of the front case 111 and liquid within the recess 112*a* of the rear case 112 may be high pressure due to the operation of a valve or a cylinder (not shown) connected to a downstream side of the gear pump. In this case, only any one of the front drive shaft 151 and the rear drive shaft 152 may move toward the seal block 8 within the gaps between the shaft and the bearings of side plates 7 and 7'. However, the joint 154 absorbs the displacement of the shaft caused by this movement. For that reason, the operation of one pump assembly does not affect the other pump assembly, and the leakage of the liquid does not increase, and the drive torque does not increase.

As described above, the gear pump 101 in which the two pump assemblies of the first embodiment are connected in series can drive both of the pump assemblies 110 and 110' with high efficiency.

Also, as with the gear pump 1 according to the first embodiment, the gear pump 101 is not required to enhance the assembling precision of the pump assemble 110 and the front case 111, and the assembling precision of the pump assemble 110' and the rear case 112, and enhances only the machining precision of the parts configuring the pump assemblies 110 and 110', as a result of which the efficiency of the gear pump can be enhanced. For that reason, the gear pump 101 is easy in assembling, and an improvement in the yield and a reduction in the costs can be performed.

Further, even in a case of a gear pump in which three or more pump assemblies are connected in series, like the gear pump 101 described in this second embodiment, the respective pump assemblies are connected by the joint 154, thereby being capable of realizing the high efficiency pump.

Also, a connection portion having the same structure as that of the joint 154 may be installed between the drive source of the front drive shaft 151 and the front drive shaft 151. With this configuration, even if there is a coaxial deviation between the drive source and the front drive shaft 151, the gear pump 101 can operate without lowering the efficiency.

LIST OF REFERENCE SIGNS

1 . . . gear pump, 2 . . . drive shaft, 3 . . . driven shaft, 4, 5 . . . gears, 4*a*, 4*a*', 5*a*, 5*a*' . . . side surfaces of gears, 6 . . . drive pin, 7, 7' . . . side plates, 8 . . . seal block, 8*a*, 8*a*', 8*a*" . . . surfaces facing a recess of a rear case of the seal block (facing surface of the seal block), 9, 9' . . . seal members, 10 . . . pump assembly, 11 . . . front case, 12 . . . rear case, 12*a* . . . recess of the rear case, 12*b*, 12*b*' . . . surfaces facing the seal block of the recess of the rear case (facing surfaces of the rear case recess), 12*c* . . . projecting portion of the recess of the rear case, 13 . . . housing, 14*a*, 14*b* . . . urging mechanisms, 15 . . . groove, 16 . . . case seal, 17 . . . recess of front case, 18 . . . oil seal, 19 . . . suction port, 20 . . . discharge port, 21 . . . abutment surface of the side plates against the seal block, 22 . . . dowel pin, 23 . . . bolt, 24 . . . anti-rotation pin, 101 . . . gear pump, 110, 110' . . . pump assembly, 111 . . . front case, 111*a* . . . recess of the front case, 112 . . . rear case, 112*a* . . . recess of the rear case, 113 . . . housing, 115, 115' . . . grooves, 116, 116' . . . case seals, 150 . . . center plate, 151 . . . front drive shaft, 151*a* . . . hole, 152 . . . rear drive shaft, 152*a* . . . hole, 153 . . . through-hole, 154 . . . joint, 155 . . . joint shaft, 156, 156' . . . joint pins, 157 . . . joint collar, 158 . . . joint seal, and 159 . . . joint washer.

The invention claimed is:

1. A gear pump, comprising:

a pair of gears that mesh with each other;

two shafts that are rotationally supported, inserted into the pair of respective gears, and rotate together with the pair of gears;

a pair of side plates arranged adjacent to both side surfaces of the pair of gears, each of the side plates having two through-holes forming bearings of the two shafts;

a seal block that abuts against the pair of side plates, and covers a part of the pair of gears in a circumferential direction, the pair of gears, the two shafts, the pair of side plates, and the seal block together forming a pump assembly; and a case having a recess in which the pump assembly is accommodated, and having a facing surface that faces the seal block on an inner wall of the case forming the recess, wherein the pump assembly has a line passing through an arc center of a cylindrical surface, which is inscribed in the facing surface of the case and is parallel to the two shafts, as a rotating axis, the pump assembly is held to be rotatable about the rotating axis, and, when the pump assembly rotates about the rotating axis, a portion of one of the pair of side plates located across one of the shafts from the rotating axis in a direction connecting the two shafts comes in contact with a projecting portion of the inner wall of the case.

2. The gear pump according to claim 1, wherein the seal block comes in contact with the facing surface of the case at two separated places on the facing surface of the case.

3. The gear pump according to claim 1, wherein one of the two shafts is a drive shaft that drives by a drive source, and the other of the two shafts is a driven shaft that rotates by receiving a rotating force from the drive shaft through the pair of gears.

4. The gear pump according to claim 1, wherein one of the two shafts is a drive shaft that drives by a drive source, the other of the two shafts is a driven shaft that rotates by receiving a rotating force from the drive shaft through the pair of gears, and the projecting portion is located across the drive shaft from the rotating axis in a direction connecting the two shafts to each other.

5. The gear pump according to claim 3, wherein the other of the pair of side plates contacts with the seal block without contacting with the case.

6. The gear pump according to claim 5, further comprising an elastic body that presses one of the pair of side plates against the recess of the case to rotate the pump assembly in the same direction as a rotating direction of the drive shaft.

7. The gear pump according to claim 5, further comprising an elastic body that presses the other of the pair of side plates against the recess of the case to bring the other of the pair of side plates into close contact with the seal block.

8. The gear pump according to claim 1, wherein the bearings of the two shafts are provided in only the pair of side plates.

9. A gear pump having a plurality of pump assemblies and a plurality of cases, each accommodating one of the plurality of pump assemblies, each of the plurality of pump assemblies comprising:

a pair of gears that mesh with each other;

two shafts that are rotationally supported, inserted into the pair of respective gears, and rotate together with the pair of gears, one of the two shafts being a drive shaft;

a pair of side plates arranged adjacent to both side surfaces of the pair of gears, each of the side plates having two through-holes forming bearings of the two shafts; and a seal block that abuts against the pair of side plates, and covers a part of the pair of gears in a circumferential direction, wherein each of the plurality of cases has a recess in which one of the pump assemblies is accommodated, and a facing surface that faces the seal block on an inner wall forming the recess, respective drive shafts of the plurality of pump assemblies are connected to each other, and each of the plurality of pump assemblies has a line passing through an arc center of a cylindrical surface, which is inscribed in the facing surface of the case and is parallel to the two shafts, as a rotating axis and is held to be rotatable about the rotating axis, and, when one of the pump assemblies rotates about the rotating axis, a portion of one of the side plates located across one of the shafts from the rotating axis in a direction connecting the two shafts comes in contact with a projecting portion of the inner wall of the case.

10. A gear pump having a plurality of pump assemblies and a plurality of cases, each accommodating one of the plurality of pump assemblies, each of the plurality of pump assemblies comprising:

a pair of gears that mesh with each other;

two shafts that are rotationally supported, inserted into the pair of respective gears, and rotate together with the pair of gears, one of the two shafts being a drive shaft;

a pair of side plates arranged adjacent to both side surfaces of the pair of gears, each of the side plates having two through-holes forming bearings of the two shafts; and a seal block that abuts against the pair of side plates, and covers a part of the pair of gears in a circumferential direction, wherein each of the plurality of cases has a recess in which one of the pump assemblies is accommodated, and a facing surface that faces the seal block on an inner wall forming the recess, respective drive shafts of the plurality of pump assemblies are connected to each other, and each of the plurality of pump assemblies has a line passing through an arc center of a cylindrical surface, which is inscribed in the facing surface of the case and is parallel to the two shafts, as a rotating axis and is held to be rotatable about the rotating axis, and, when one of the pump assemblies rotates about the rotating axis, a portion of one of the side plates located across one of the shafts from the rotating axis in a direction connecting the two shafts comes in contact with a projecting portion of the inner wall of the case;

the gear pump further comprising a torque transmission mechanism that transmits only torques of the drive shafts, and absorbs a coaxial misalignment, connecting respective drive shafts of the pump assemblies to each other.

* * * * *